US006748787B1

(12) United States Patent
Liu

(10) Patent No.: US 6,748,787 B1
(45) Date of Patent: Jun. 15, 2004

(54) METHOD OF PRODUCING WORKPIECE HAVING IRREGULAR CROSS SECTION BY STAMPING THIN PLATE INTO THICK PLATE

(75) Inventor: Wen-Han Liu, Taipei (TW)

(73) Assignee: Rulong Precision Industry Co., Ltd., Taipei Hsien (TW)

( * ) Notice: Subject to any disclaimer, the term of this patent is extended or adjusted under 35 U.S.C. 154(b) by 779 days.

(21) Appl. No.: 09/712,253

(22) Filed: Nov. 15, 2000

(30) Foreign Application Priority Data

Oct. 2, 2000 (TW) ..... 89120496 A

(51) Int. Cl.[7] ..... B21D 31/06
(52) U.S. Cl. ..... 72/379.2; 72/334; 72/404
(58) Field of Search ..... 72/324, 325, 334, 72/379.2, 356, 404

(56) References Cited

U.S. PATENT DOCUMENTS 3,387,481 A * 6/1968 Harvey et al. ..... 72/256
3,765,217 A * 10/1973 Ikeda ..... 72/334
4,783,985 A * 11/1988 LaBarge et al. ..... 72/379.2

* cited by examiner

*Primary Examiner*—Lowell A. Larson

(57) ABSTRACT

A method of producing workpiece having irregular cross section by stamping thin plate into thick plate is provided. In the method, a thin plate having a uniform thickness corresponding to that of a thinner area to be formed on the workpiece is used. Multiple stamping heads having different and gradually increased bevel angles are used one by one to stamp one or two sides of the thin plate at a predetermined scrap area, so that a part of the scrap area is gradually compressed and pushed toward a specific area that is to have larger thickness on said workpiece. When the specific area bumps to a predetermined height, a stamping mold is used to downward stamp the bumped area into a predetermined shape. Thereafter, the remained scrap area on the thin plate is removed to obtain the desired workpiece. The method enables largely reduced scrap and manufacturing time and cost in forming a workpiece having irregular cross section.

8 Claims, 9 Drawing Sheets

METHOD OF PRODUCING WORKPIECE HAVING IRREGULAR CROSS SECTION BY STAMPING THIN PLATE INTO THICK PLATE

BACKGROUND OF THE INVENTION

The present invention relates to a method of producing workpiece having irregular cross section, and more particularly to a method of producing workpiece having irregular cross section by stamping a thin plate into a thick plate. In the method, predetermined scrap areas on the thin plate are continuously stamped so that some parts of these scrap areas are compressed and pushed toward non-continuous specific areas on the thin plate for forming thicker areas on the workpiece.

A conventional connecting terminal as shown in FIG. 1, or a contact element in a connector, or a contact element in a relay will frequently come into contact with other elements when the terminal, the connector or the relay is in use. It is a common practice to increase the thickness of the areas of such connecting terminal or contact element that are frequently contacted with other elements, so that the terminal or the connector or the relay may have longer useable life or higher wear resistance. Such element having areas of different thickness is usually referred to as the workpiece having irregular cross section.

In a conventional method for producing the above-described workpiece having irregular cross section, a plate having a uniform thickness T corresponding to a largest thickness to be formed on the workpiece is selected for use. Areas on the plate that are to be thinned for forming thinner areas on the workpiece are fabricated by milling, as shown in FIG. 2, to obtain a desired thickness t. Thereafter, the milled plate is further rolled or ground to provide a plate having the desired irregular cross section as that to be formed on the workpiece. The plate is then stamped to obtain the workpiece having a desired profile and the desired irregular cross section.

In the process of milling the plate to obtain the desired irregular cross section, high temperature tends to occur at the surface being milled and results in changes of the physical properties of the plate, such as uneven thickness or varied hardness. Such changes in physical properties frequently cause unexpected changes in the thickness of the milled plate and accordingly, difficulties in subsequent stable fabrication of the plate. Moreover, the plate selected for use has an initial thickness corresponding to that for the thickest area on the complete workpiece. A large part of the thick plate is milled to meet the thickness for the thinner areas to be formed on the complete workpiece and therefore unnecessarily produces a large amount of scraps. Burrs and warps also tend to occur at ends and edges of the milled surfaces to cause poor quality of the produced workpiece. In the event the workpiece has discontinuous thicker areas, such milling process must be locally proceeded at such thicker areas one by one and the tool used to mill the plate must be differently adjusted for each area to obtain the desired stepped surface of the workpiece. Such milling process is time consuming and increases the manufacturing cost thereof and it is impossible to proceed the milling at different stages in an automated manner.

SUMMARY OF THE INVENTION

It is therefore a primary object of the present invention to provide a method of producing a workpiece having irregular cross section by stamping a thin plate into a thick plate. In this method, a plate having a uniform thickness corresponding to a smallest thickness to be formed on the workpiece is used, so that cost and time that is otherwise needed to mill the plate can be saved and scrap that would be produced in the stamping is largely reduced to lower the manufacturing cost of the workpiece.

To achieve the above and other objects of the present invention, there is provided a method of producing a workpiece having irregular cross section, in which a thin plate having a uniform thickness corresponding to that of a thinner area to be formed on the workpiece is used. Multiple stamping heads having different and gradually increased bevel angles are used one by one to stamp one or two sides of the thin plate at predetermined scrap areas, so that parts of the scrap areas are gradually compressed and pushed toward specific areas that are to have a larger thickness on the workpiece. When the specific areas bump to a predetermined height through continuous stamping of the scrap areas, stamping molds are used to downward stamp the bumped areas into a predetermined shape. Thereafter, the remained scrap areas on the thin plate are removed to obtain the desired workpiece. With the method of the present invention, thickness of the workpiece at different areas can be precisely controlled and the producing of a workpiece having discontinuous thicker areas can be achieved through automated fabrication processes. The method also enables largely reduced scrap and manufacturing time and cost in forming the workpiece having irregular cross section.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
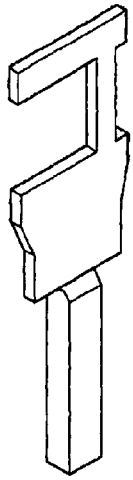
(PRIOR ART) Fig.1
FIG. 1 is a perspective of a general workpiece having irregular cross section.
Figure 2:
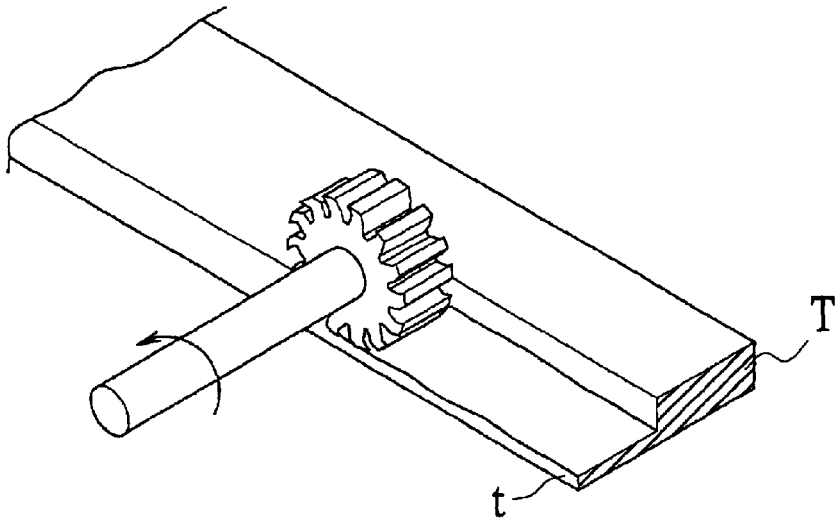
(PRIOR ART) Fig.2
FIG. 2 schematically shows the manner of thinning a thick plate through milling.
Figure 3:
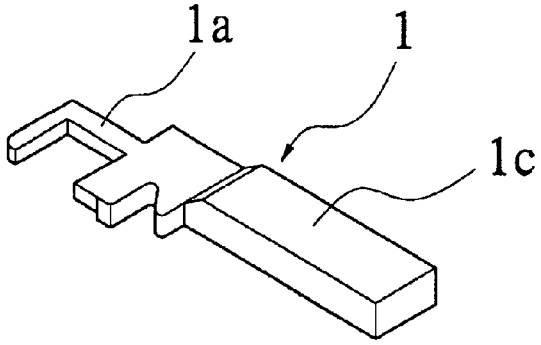
FIG. 3 is a perspective of a workpiece having irregular cross section produced with the method of the present invention.
Figure 4:
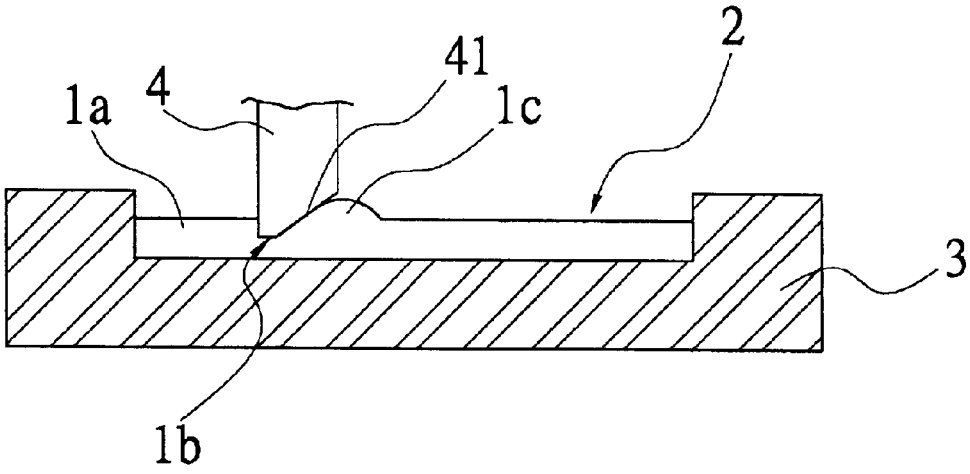
FIG. 4 is a cross sectional view showing the first step of the method of the present invention to produce a workpiece having irregular cross section.

Please refer to FIG. 3 that shows an example of a workpiece 1 having irregular cross section that could be produced with the method of the present invention. In this method, a thin plate 2 having a uniform thickness corresponding to that of a thinner area 1*a* to be formed on the workpiece 1 is used, as shown in FIG. 4. After the thin plate 2 is selected, the workpiece 1 is produced in the following steps:

Step 1: Securely position the thin plate 2 in a mold cavity 3. Prepare a series of sequentially arranged stamping heads above the thin plate. Use a first stamping head 4 having a first bevel surface 41 to stamp one side of the thin plate 2 at a predetermined scrap area 1*b* that is eventually to be removed from the thin plate 2. Control the first stamping head 4 so that the stamped scrap area 1*b* is gradually compressed and pushed toward an area 1*c* that is to form an area on the workpiece 1 having a larger thickness. The stamping is continued until the area 1*c* bumps to a predetermined height or thickness.

Figure 5:
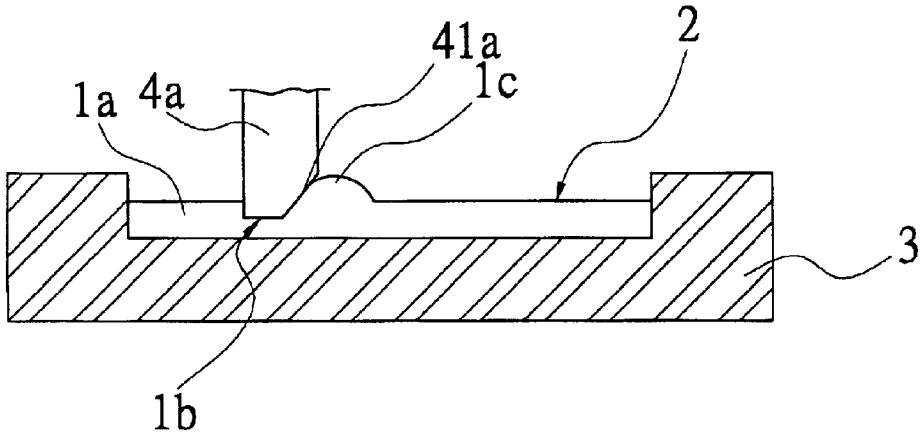
FIG. 5 is a cross sectional view showing the second step of the method of the present invention.

Step 2: As shown in FIG. 5, the thin plate 2 in the mold cavity 3 is transferred via an automatic conveyer (not shown) to a position below a second stamping head 4*a* having a second bevel surface 41*a* that has a bevel angle larger than that of the first bevel surface 41. Use the second stamping head 4*a* to stamp the plate 2 further at the predetermined scrap area 1*b*, so that the second bevel surface 41*a* compresses and pushes more part of the scrap area 1*b* toward a center of the already bumped area 1*c*, making the bumped area 1*c* to be even higher.

Figure 6:
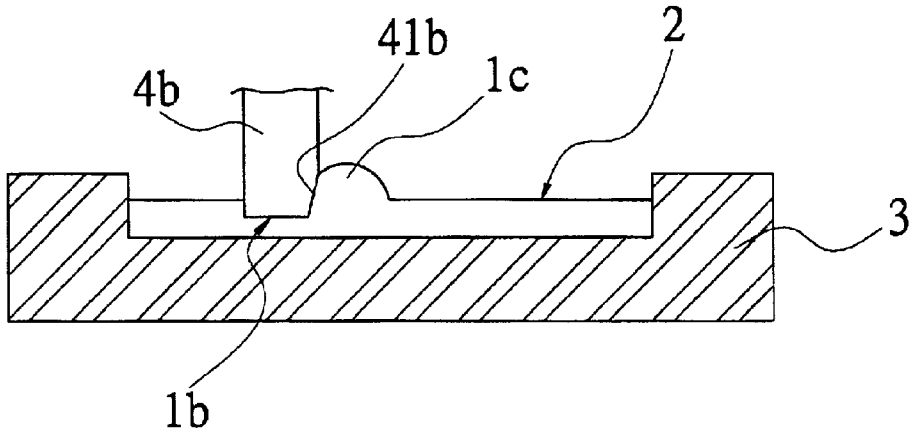
FIG. 6 is a cross sectional view showing the third step of the method of the present invention.

Step 3: As shown in FIG. 6, the thin plate 2 in the mold cavity 3 past the second step is transferred to locate below a third stamping head 4*b* having a third bevel surface 41*b* that has a bevel angle larger than that of the first and the second bevel surfaces 41, 41*a*. When the third stamping head 4*b* is used to downward stamps the plate 2 further at the scrap area 1*b*, the third bevel surface 41*b* compresses and pushes more part of the scrap area 1*b* toward a center of the highly bumped area 1*c*, so that the area 1*c* reaches a predetermined height or thickness.

Figure 7:
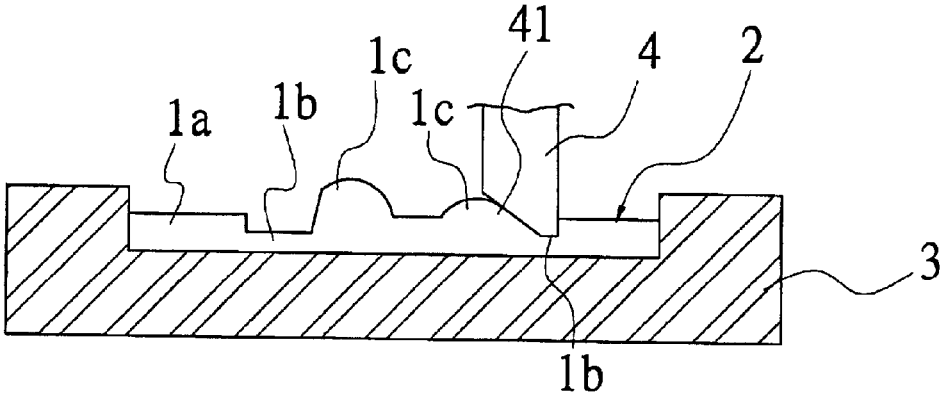
FIG. 7 is a cross sectional view showing the employment of the first step of the method of the present invention in producing the workpiece having irregular cross section.
Figure 8:
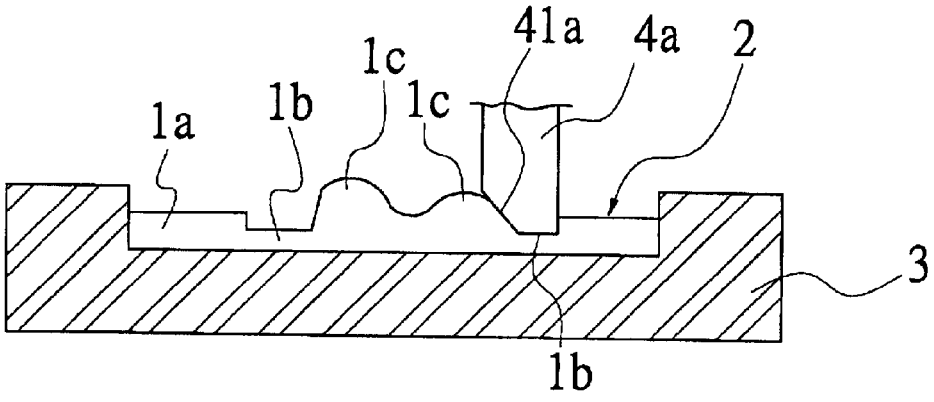
FIG. 8 is a cross sectional view showing the employment of the second step of the method of the present invention in producing the workpiece having irregular cross section.
Figure 9:
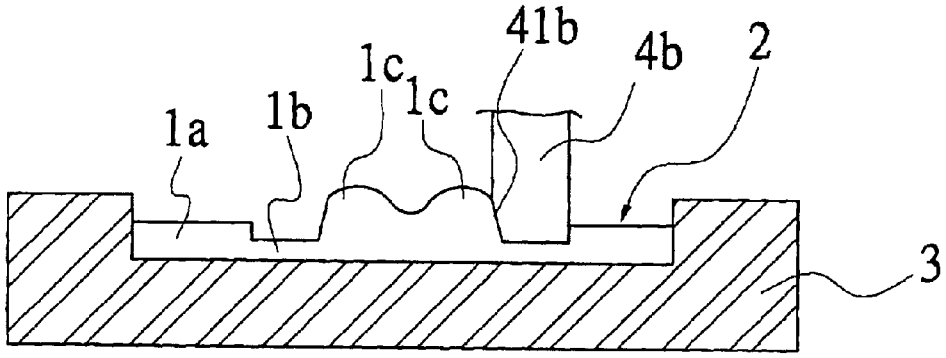
FIG. 9 is a cross sectional view showing the employment of the third step of the method of the present invention in producing the workpiece having irregular cross section.
Figure 10:
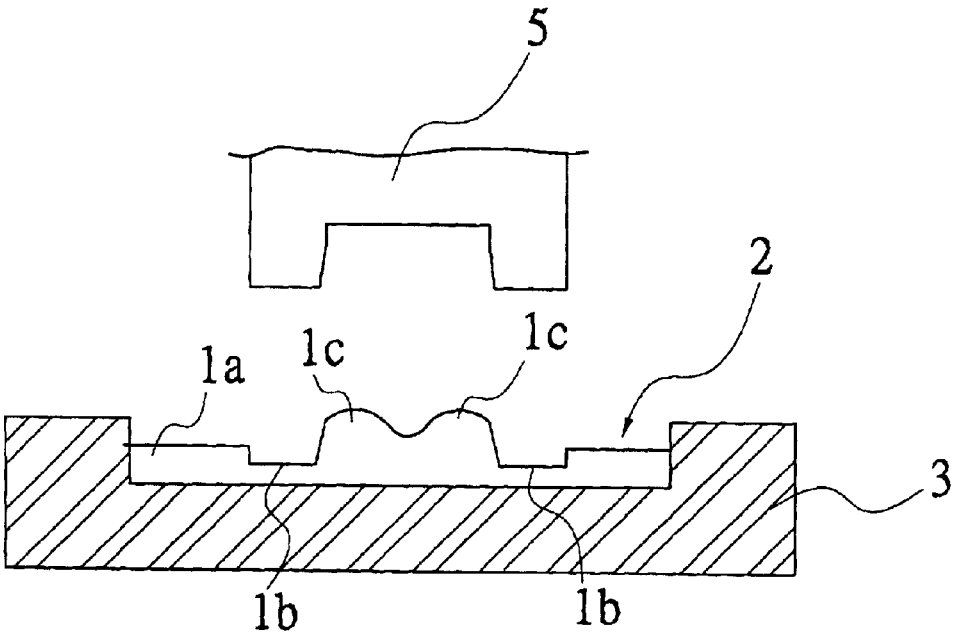
FIG. 10 is a cross sectional view showing the fourth step of the method of the present invention, wherein a stamping mold has not been stamped onto the half-finished workpiece.
Figure 11:
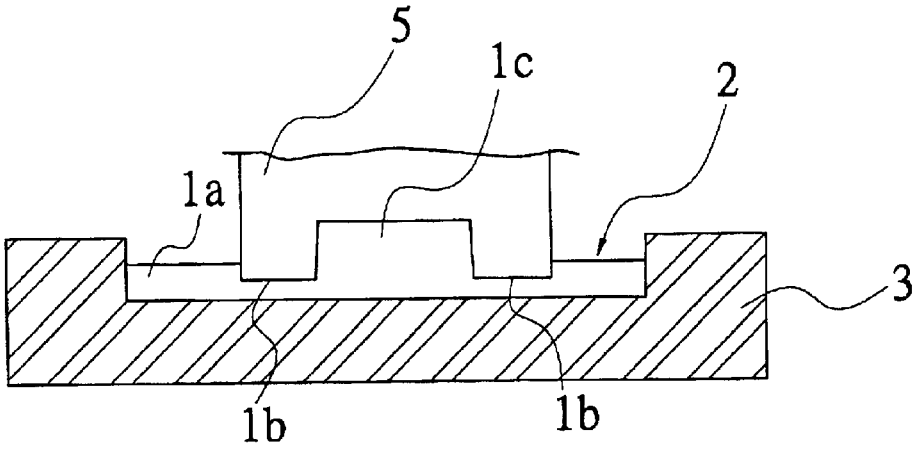
FIG. 11 is another cross sectional view showing the fourth step of the method of the present invention, wherein the stamping mold has been stamped onto the half-finished workpiece.
Figure 12:
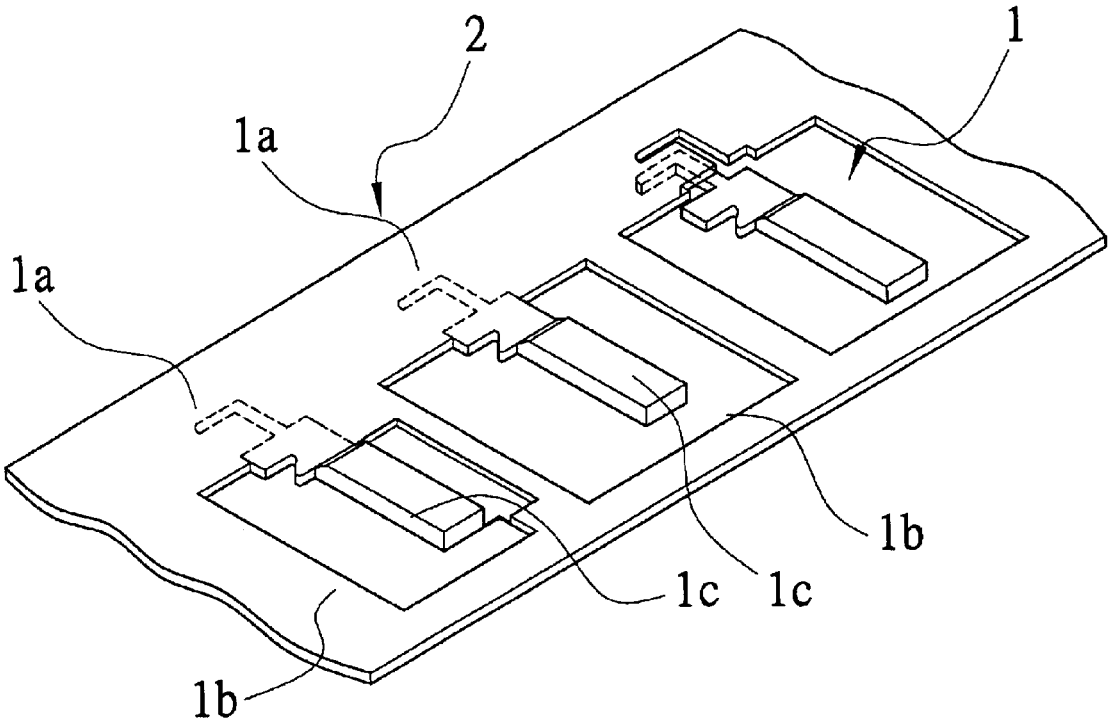
FIG. 12 shows a series of continuous movements of the fourth step of the method of the present invention in producing the workpiece having irregular cross section.

Step 4: As shown in FIGS. 7 to 9, the above-described steps 1 to 3 are sequentially repeated on the plate 2 at other predetermined scrap areas 1*b*, so that parts at these scrap areas 1*b* are compressed and pushed toward the center of the predetermined area 1*c* for the latter to bump higher and reach the predetermined height or thickness. At this point, a stamping mold 5 is used to downward stamp the bumped area 1*c*, as shown in FIGS. 10 and 11, so that the bumped area 1*c* is molded into a shape intended for the thicker area 1*c* on the workpiece 1, as shown in FIG. 12.

Finally, remove the remaining scrap areas 1*b* on the plate 2 according to the predetermined configuration for the workpiece 1, so that the workpiece 1 having desired irregular cross section shown in FIG. 3 is obtained.

The above-described method has the following advantages:

1. It is possible to produce the workpiece 1 having irregular cross section depending on particular requirements set for the workpiece 1, so that specific configuration and thickness could be formed at specified area as required.
2. The thickness for any specific area on the workpiece 1 could be precisely controlled in stamping the plate 2.
3. In the event the workpiece 1 having irregular cross section has thicker areas that are not continuously arranged on the workpiece 1, such discontinuous thicker areas could still be obtained through automated fabrication of stamping to largely simplify the manufacturing process and reduce the manufacturing time that is otherwise needed in the conventional milling process.
4. The amount of scrap could be largely reduced to effectively lower the manufacturing cost.

Figure 13:
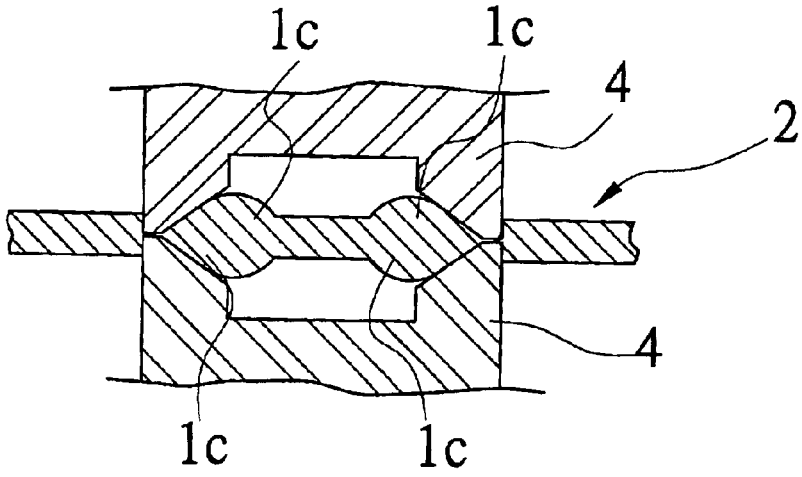
FIGS. 13 to 15 illustrate another manner of using the method of the present invention to produce a workpiece having irregular cross section.
Figure 14:
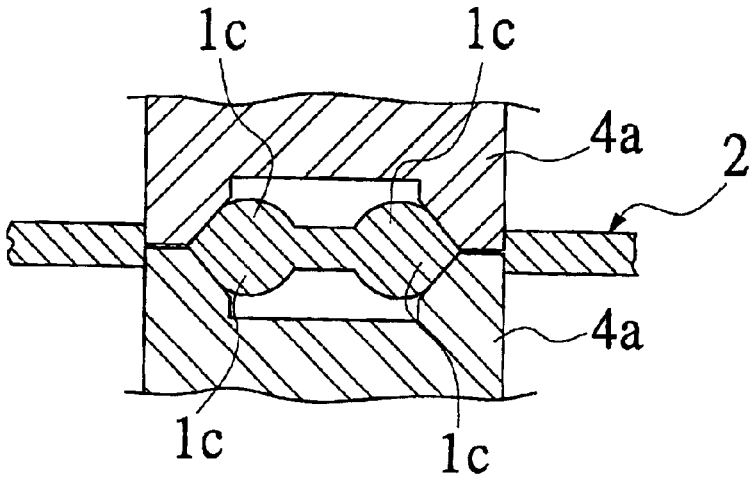
Figure 15:
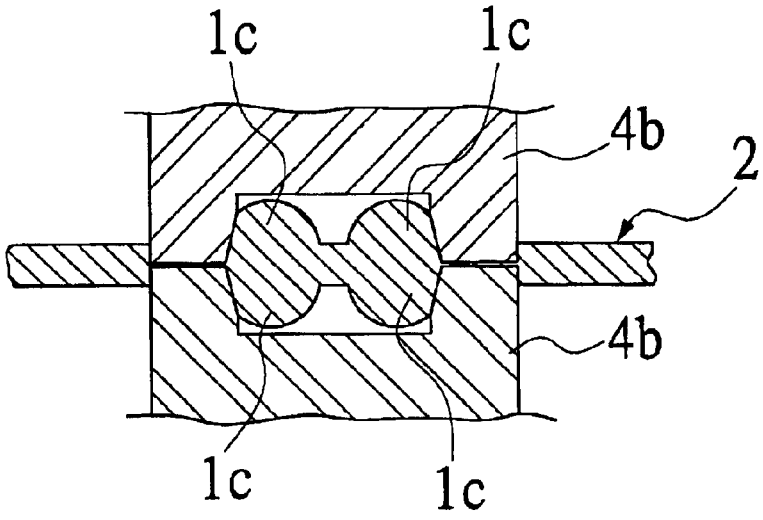
Figure 16:
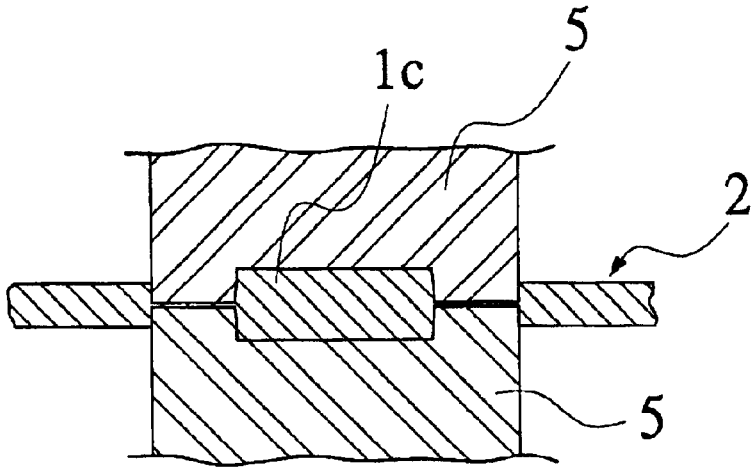
FIG. 16 shows the use of a stamping mold to stamp the half-finished workpiece produced in FIGS. 13 to 15.

FIGS. 13 to 15 illustrate another manner of using the method of the present invention to produce a workpiece having irregular cross section. In this case, two stamping heads 4 are separately positioned above and below the thin plate 2 at places decided by areas 1*c* that are to be thicker than other areas on the workpiece 1. The stamping heads 4 may be particularly designed and formed depending on the distribution of the thicker areas 1*c* on two sides of the workpiece 1, so that stamping of the thin plate 2 at two different positions from two sides of the plate 2 may be synchronously proceeded. In the above-mentioned two-position two-side stamping, the steps 1, 2, 3 and 4 of the method of the present invention are sequentially employed with the stamping heads 4, 4*a* and 4*b* arranged in series to work at the predetermined scrap areas 1*b* step by step, so that parts of the scrap areas 1*b* are gradually compressed and pushed toward centers of the predetermined thicker areas 1*c* for the latter to reach the predetermined thickness. Thereafter, upper and lower stamping molds 5 are used at the same time to stamp the thicker areas 1*c* into the desired configuration, as shown in FIG. 16. Finally, the remained scrap areas 1*b* are removed according to the predetermined profile of the workpiece 1, so that the workpiece 1 as shown in FIG. 3 could be obtained.

Figure 17:
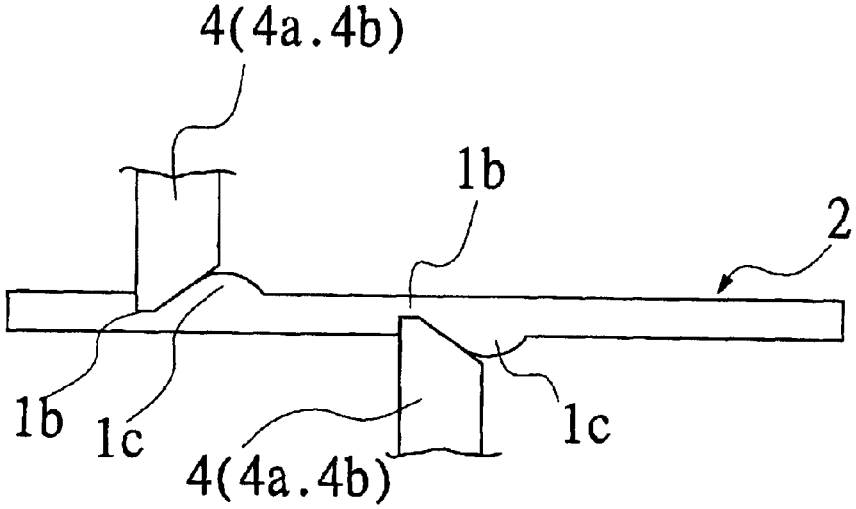
FIG. 17 is a cross sectional view showing a further manner of using the method of the present invention to produce a workpiece having irregular cross section.

In actual use or assembling of the workpiece 1 having irregular cross section, it is possible that two adjacent workpieces 1 are to be staggered and located in opposite directions. In this case, it is necessary to stagger areas on a continuous long plate 2 for formed workpieces 1 to stagger at upper and lower sides of the plate 2. By controlling intervals between the stamping heads 4, 4*a* and 4*b* and time for conveying the plate 2, the steps of the method of the present invention may be implemented at two sides of the plate 2 at the same time, as shown in FIG. 17, so that two adjacent and staggered workpieces 1 could be completed synchronously in the same one conveyance of the plate 2. In this manner, the whole manufacturing process for forming the workpiece 1 could be completed at shortened time and increased productivity to largely reduce the manufacturing cost thereof.

The stamping mold 5 is designed according to the profile of the thicker areas 1*c* to be formed on the workpiece 1. An interior of the stamping mold 5 may be of any shape as long as it could stamp the bumped area 1*c* into the desired configuration. It is apparent that many changes and modification in the internal geometric shape of the stamping mold 5 can be carried out without departing from the spirit of the invention.

What is claimed is:

1. A method of producing workpiece having irregular cross section by stamping thin plate into thick plate, in which a thin plate having a uniform thickness corresponding to that of a thinner area to be formed on said workpiece is used, said method comprising the following steps: securely positioning said thin plate in a mold cavity; preparing a series of sequentially arranged stamping heads having respective bevel surfaces of different bevel angles, so that said stamping heads could be sequentially shifted to align with a predetermined scrap area on said thin plate; using said stamping heads one by one to stamp said thin plate at said predetermined scrap area so that a part of said scrap area is gradually compressed and pushed toward a specific area that is to have larger thickness on said workpiece; keeping stamping said scrap area with said stamping heads having increased bevel angles until said specific area to have larger thickness bumps and reaches a predetermined thickness; using a stamping mold to downward stamp said bumped area into a predetermined shape; and stamping off said scrap area that has been partially stamped and thinned and other unused areas on said thin plate according to a configuration preset for said workpiece; whereby said workpiece could be fabricated through automated stamping processes to have thicker areas discontinuously distributed thereon at largely reduced scrap and manufacturing cost.

2. A method of producing workpiece having irregular cross section by stamping thin plate into thick plate as claimed in claim 1, wherein said stamping heads are located at one side of said thin plate.

3. A method of producing workpiece having irregular cross section by stamping thin plate into thick plate as claimed in claim 1, wherein said stamping heads are located at upper and lower sides of said thin plate and are formed depending on a predetermined distribution manner of said thicker areas on said workpiece to compress and push said scrap area from upper and lower sides thereof and at two corresponding positions.

4. A method of producing workpiece having irregular cross section by stamping thin plate into thick plate as claimed in claim 1, wherein said stamping heads are staggered at upper and lower sides of said thin plate to achieve synchronous manufacturing of two adjacent workpieces from two sides of said thin plate through controlling of intervals between two adjacent stamping heads at two sides of said thin plate and time for stamping said scrap area on said thin plate.

5. A method of producing workpiece having irregular cross section by stamping thin plate into thick plate as claimed in claim 2, wherein said stamping heads are sequentially used to stamp said scrap area from the one having a smallest bevel angle to the one having a largest bevel angle.

6. A method of producing workpiece having irregular cross section by stamping thin plate into thick plate as claimed in claim 3, wherein said stamping heads are sequentially used to stamp said scrap area from the one having a smallest bevel angle to the one having a largest bevel angle.

7. A method of producing workpiece having irregular cross section by stamping thin plate into thick plate as claimed in claim 4, wherein said stamping heads are sequentially used to stamp said scrap area from the one having a smallest bevel angle to the one having a largest bevel angle.

8. A method of producing workpiece having irregular cross section by stamping thin plate into thick plate as claimed in claim 1, wherein said stamping mold may be of any internal configuration that is determined completely depending on a profile of said thicker area to be formed on said workpiece.

* * * * *